US010085527B2

(12) United States Patent
Hamada

(10) Patent No.: US 10,085,527 B2
(45) Date of Patent: Oct. 2, 2018

(54) SLIDER ASSEMBLY FOR A SLIDE FASTENER

(71) Applicant: YKK Corporation, Tokyo (JP)

(72) Inventor: Yoshikazu Hamada, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/476,659

(22) Filed: Mar. 31, 2017

(65) Prior Publication Data

US 2017/0290394 A1 Oct. 12, 2017

(30) Foreign Application Priority Data

Apr. 6, 2016 (IT) ..... 102016000035149

(51) Int. Cl.
*A44B 19/30* (2006.01)
*A44B 19/26* (2006.01)

(52) U.S. Cl.
CPC ..... *A44B 19/308* (2013.01); *A44B 19/262* (2013.01); *A44B 19/306* (2013.01); *H05K 999/99* (2013.01)

(58) Field of Classification Search
CPC ..... A44B 19/262; A44B 19/308
See application file for complete search history.

(56) References Cited

U.S. PATENT DOCUMENTS 2,303,751 A * 12/1942 Marinsky ..... A44B 19/308 24/424
2,784,474 A * 3/1957 Morin ..... A44B 19/308 24/424
2012/0260469 A1 10/2012 Yamamoto et al.

FOREIGN PATENT DOCUMENTS

| | | | |
|---|---|---|---|
| EP | 0451624 | A1 | 10/1991 |
| GB | 769468 | | 3/1957 |
| GB | 2093521 | A | 9/1982 |
| JP | S51-004809 | Y1 | 2/1976 |
| WO | 2008/081471 | A1 | 7/2008 |

OTHER PUBLICATIONS

Search Report, Italian Patent Application No. IT UA20162338, dated Dec. 9, 2016.

* cited by examiner

*Primary Examiner* — Robert Sandy
(74) *Attorney, Agent, or Firm* — Kilpatrick Townsend & Stockton LLP

(57) ABSTRACT

There is provided a slider assembly for a slide fastener, including: a slider body; a pull-tab; and a resilient locking member. The pull-tab is provided with a window aligned with an aperture in an upper wing of the slider body when the pull-tab is in a first angular end position. A distal end of the locking member extends towards a guide channel through the window and the aperture. The locking member is configured to be resiliently biased towards a locking position where a distal end thereof protrudes in the guide channel. A proximal end of the pull-tab has a cam cooperating with the locking member such that the locking member takes the locking position when the pull-tab is in the first angular end position, and the locking member is moved towards an unlocking position when the pull-tab is pivoted away from the first angular end position.

6 Claims, 4 Drawing Sheets

SLIDER ASSEMBLY FOR A SLIDE FASTENER

The present application claims priority to Italian Patent Application No. 102016000035149, filed on Apr. 6, 2016 and entitled "A Slider Assembly for A Slide Fastener," the entire contents of which are hereby incorporated by reference.

DESCRIPTION

Field of the Invention

The present invention relates to a slider assembly for a slide fastener, of the kind having a locking feature.

BACKGROUND

A slider typically includes a slider body and a pull tab. The slider body interacts with coupling elements provided on confronting sides of two cooperating tapes to open and close a zipper or slide fastener. When the slider body is moved by pulling the pull-tab, a generally Y-shaped channel located between a top wing and a bottom wing of the slider body meshes together rows of opposing coupling elements of the tapes. When the slider body is moved in the opposite direction, the Y-shaped channel separates the rows of opposing coupling elements.

To prevent the slide fastener from inadvertently opening or closing, some sliders are provided with a locking feature. When the pull-tab is in at least one particular orientation, a locking member engages with the coupling elements of at least one tape, to prevent the slider from moving. When the pull-tab is not in said one particular orientation (for example, is raised so that it is approximately perpendicular to the tapes), the locking member does not engage with the coupling elements of the tapes, and the slider is permitted to move.

Sliders having this type of locking feature are sometimes referred to as "semi-automatic" sliders.

Embodiments of such sliders are disclosed for instance in Patent Document 1 (GB 769 468 A) and Patent Document 2 (US 2012/0260469 A1).

In the slider according to Patent Document 1 (GB 769 468 A) the locking member is a finger integrally formed with the proximal end of the pull-tab. A helical torsion spring is provided, for biasing the pull-tab towards a position approximately parallel with the tapes of the slide fastener, in which said finger prevents the slider from being displaced.

In the slider according to Patent Document 2 (US 2012/0260469 A1) a resilient locking member having a quite complicated shape, preferably made of metal, such as stainless steel, is used. Said resilient locking member is completely exposed in use, and unwanted debris maybe trapped between it and the slider body, with a risk of jamming the operation thereof.

SUMMARY

One object of the present invention is to provide an improved slider assembly for a slide fastener having a locking feature.

This and other objects are achieved by a slider assembly according to an aspect of the embodiments of the present invention.

There is provided a slider assembly for a slide fastener, comprising: a slider body; a pull-tab; and a resilient locking member, wherein the slider body has upper and lower wings linked by a post and an essentially Y-shaped guide channel defined between the upper wing and the lower wing, wherein an upper surface of the upper wing has a recess extending in a longitudinal direction of the slider body, wherein the recess has two confronting side walls and a bottom wall disposed between the two confronting side walls, wherein the upper wing is provided with an aperture putting the recess in communication with the guide channel, wherein the pull-tab has a distal end adapted to be gripped and a proximal end pivotably mounted in the recess of the upper wing, between the two confronting side walls thereof, wherein the slider assembly is provided with a pivot pin which extends in a transverse direction of the slider body, through holes in the two confronting side walls and a hole in the proximal end of the pull-tab, wherein the pull-tab is provided with a window which is aligned with the aperture in the upper wing when the pull-tab is in a first angular end position relative to the slider body, wherein the locking member has a proximal end retained to the slider body, an intermediate portion extending in the recess around the proximal end of the pull-tab, and a distal end extending towards the guide channel through the window in the pull-tab and the aperture in the upper wing, wherein the locking member is configured such that the locking member is resiliently biased towards a locking position in which the distal end thereof protrudes to a predetermined extent in the guide channel, and wherein the proximal end of the pull-tab has a cam cooperating with the locking member such that the locking member takes the locking position when the pull-tab is in the first angular end position, and the locking member is moved towards an unlocking position when the pull-tab is pivoted away from the first angular end position.

In the slider assembly, the bottom wall of the recess may be provided with a longitudinal groove, and the intermediate portion of the locking member may extend at least in part inside the longitudinal groove.

In the slider assembly, on at least one side of right and left sides of the longitudinal groove with respect to the longitudinal direction of the slider body the bottom wall of the recess may form a sloping surface slanting upwardly towards a front portion of the slider body, and the pull-tab may abut against the sloping surface in a second angular end position, with an inclination of less than 180° with respect to the first angular end position.

In the slider assembly, the cam may be configured such that the locking member takes the locking position also when the pull-tab is in the second angular end position.

In the slider assembly, a bottom wall of the longitudinal groove, in a front portion of the slider body, may be provided with a well, and the proximal end of the locking member may be engaged with the well and retained to the slider body.

In the slider assembly, a transverse width of the proximal portion of the pull-tab may be essentially equal to a transverse width of the recess, and a transverse width of the intermediate portion of the locking member may be essentially equal to a transverse width of the longitudinal groove.

Thanks to the above indicated aspects a slider assembly according to the embodiments of the present invention has a number of advantages.

The slider body and the pull-tab can be made of a metal material, like aluminum or zinc alloys, which can be finished with a coating of another material, applied for instance by plating. Such finishing treatments may be applied to the slider body and possibly other parts of the slider after their shapes have been finalized, and do not need to be subjected to any further processing.

In a slider assembly according to the embodiments of the present invention the locking member, and possibly also the pull-tab, are protected from the intrusion of unwanted debris which might interfere with the operation thereof.

BRIEF DESCRIPTION OF THE DRAWINGS

Further features and advantages of the present invention will become apparent from the following description, provided merely by way of a non-limiting example, with reference to the attached drawings wherein.

DETAILED DESCRIPTION

Figure 1:
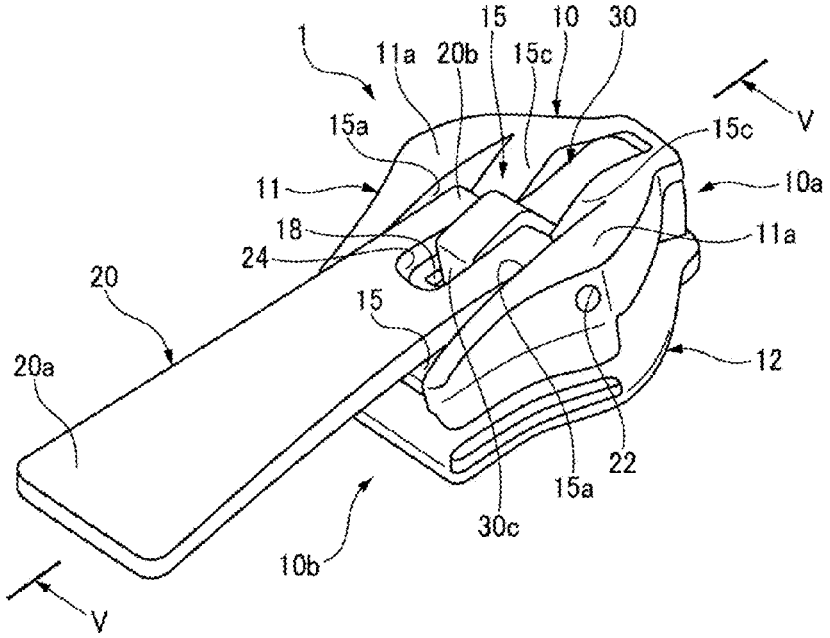
FIG. 1 is a rear perspective view of a slider assembly for a slide fastener according to the present invention.

In the embodiment illustrated in the drawings a slider assembly 1 according to the present invention includes a slider body 10 with a front portion 10*a* and a rear portion 10*b*.

Figure 4:
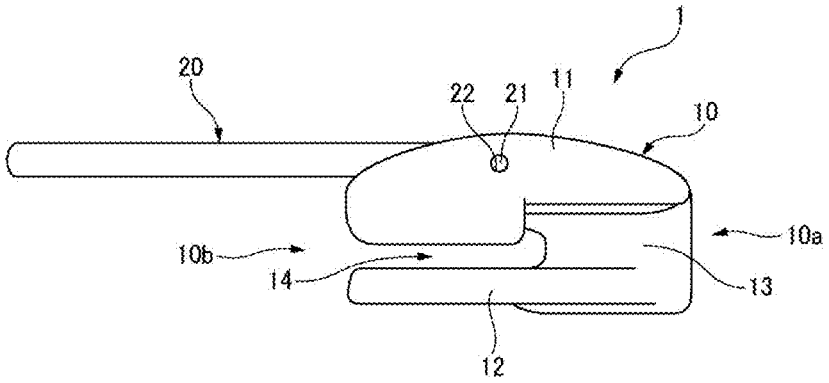
FIG. 4 is a side elevational view of said slider assembly.
Figure 5:
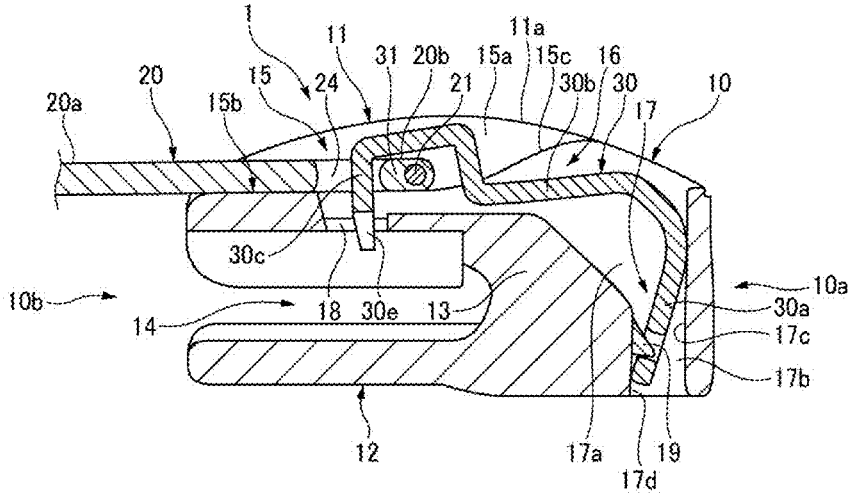
FIG. 5 is a partial sectional view taken along line V-V of FIG. 1.
Figure 6:
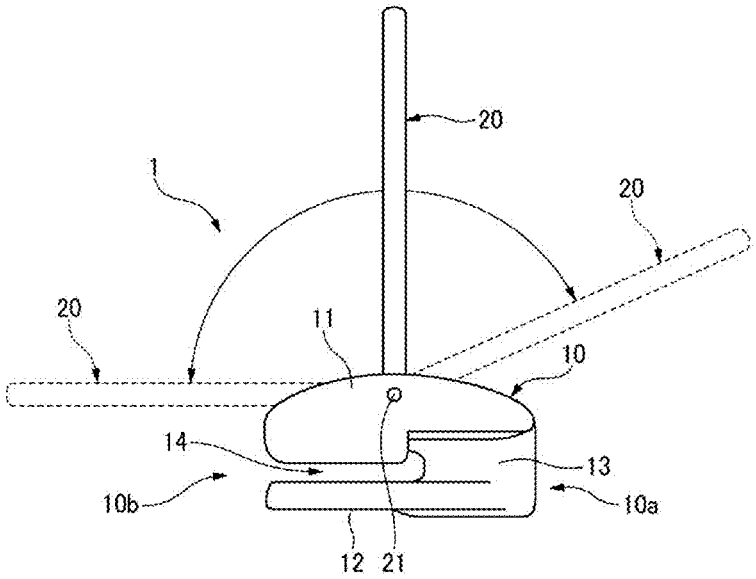
FIG. 6 is a side elevational view of said slider assembly, showing the pull-tab in different angular positions.

The slider body 10 has upper and lower wings or blades 11 and 12, arranged to be substantially parallel to each other and linked by a guide post 13 extending vertically in the front portion 10*a* (see in particular FIGS. 4 to 6).

The upper and lower wings 11 and 12 and the guide post 13 are configured such that an essentially Y-shaped guide channel 14 is defined therebetween. The guide channel 14 is formed in a per se known manner.

Figure 2:
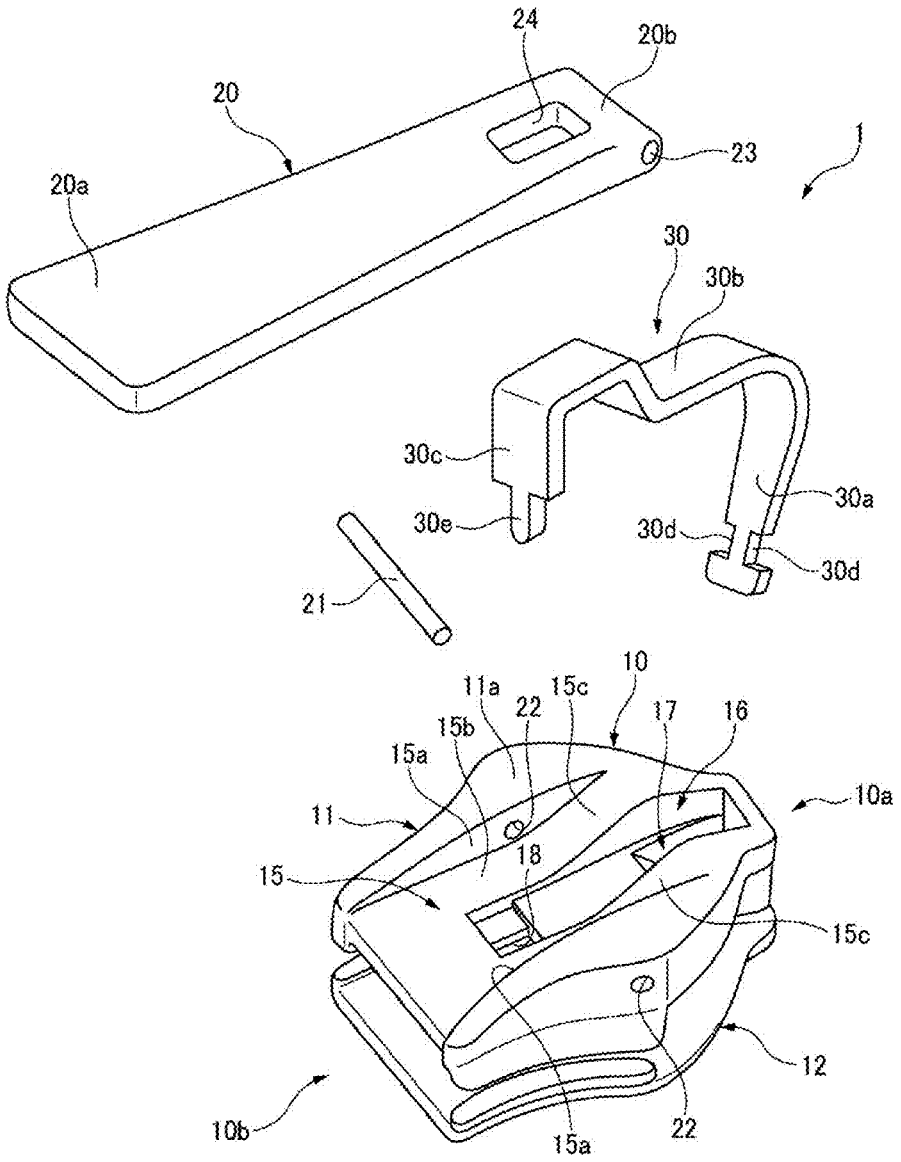
FIG. 2 is a perspective exploded view of the slider assembly of FIG. 1.
Figure 3:
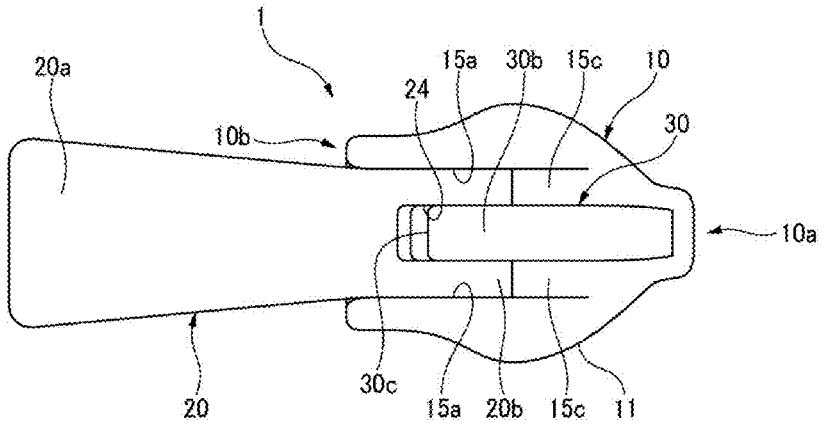
FIG. 3 is a top plan view of said slider assembly.

Referring in particular to FIGS. 1, 2 and 5, an upper surface 11*a* of the upper wing 11 is formed with a recess 15 which extends in the longitudinal direction of the slider body 10, i.e. from the rear portion 10*b* of the slider body towards the front portion 10*a*.

The recess 15 has two confronting side walls 15*a* and a bottom wall 15*b* disposed between the two confronting side walls 15*a* (see in particular FIGS. 2 and 5).

The bottom wall 15*b* of the recess 15 is provided with a longitudinal groove 16.

On at least one side of right and left sides of the longitudinal groove 16 with respect to the longitudinal direction of the slider body 10, the bottom wall 15*b* of the recess 15 forms a sloping surface 15*c* slanting upwardly towards the front portion 10*a* of the slider body 10 (see in particular FIG. 2).

With reference to FIG. 5, in the front portion 10*a* of the slider body 10 a well 17 extends from the bottom wall of the longitudinal groove 16 to the lower surface of the lower wing 12.

As best seen in FIGS. 2 and 5, the upper wing 11 of the slider body 10 is provided with an aperture 18 putting the recess 15 in communication with the underlying guide channel 14.

In the illustrated embodiment the well 17 has an upper portion 17*a* (see FIG. 5) which is essentially shaped like a trough with a cross section tapering downwardly, and a lower portion 17*b* having an essentially constant transverse cross section.

With reference to FIG. 5, the lower portion 17*b* of the well 17 is formed between a front wall 17*c* and a rear wall 17*d* which face each other. A pair of parallel nose-like projections 19 extend from the rear wall 17*d* toward the front wall 17*c* of the well 17. The pair of projections 19 are transversely aligned with each other, through separated from one another. Only one of the pair of projections 19 can be seen in FIG. 5.

The slider assembly 1 further comprises a pull-tab 20. The pull-tab 20 has a distal end 20*a* adapted to be gripped by fingers and a proximal end 20*b* pivotably mounted in the recess 15 of the upper wing 11, between the two confronting side walls 15*a*.

The pull-tab 20 is mounted rotatable about a pivot pin 21. The pivot pin 21 extends in the transverse direction of the slider body 10 through holes 22 in the two confronting side walls 15*a* and a hole 23 provided in the proximal end 20*b* of the pull-tab 20 (see in particular FIG. 2).

The pull-tab 20 at the proximal end 20*b* thereof is further provided with a window 24. As shown in FIGS. 1 and 5, the window 24 is aligned with the aperture 18 in the upper wing 11 when the pull-tab 20 is in a predetermined first angular end position relative to the slider body 10 (i.e. the position shown in FIGS. 1 and 3 to 5).

The slider assembly 1 further comprises a resilient locking member 30. The locking member 30 is made for instance of metal, such as stainless steel, or any other suitable material that is configured to return to its original shape or configuration after flexing or bending.

In the illustrated embodiment the locking member 30 is in the form of a shaped strip. The locking member 30 has a proximal end 30*a* retained to the slider body 10 as shown in FIG. 5, an intermediate portion 30*b* extending in the longitudinal groove 16 and the recess 15 and passing around the proximal end 20*b* of the pull-tab 20, and a distal end 30*c* which extends towards the guide channel 14 through the window 24 in the pull-tab and the aperture 18 in the upper wing 11 of the slider body 10. The distal end 30*c* has at a tip thereof a stopper claw 30*e* having a width narrower than that of the distal end 30*c*.

In the illustrated embodiment the intermediate portion 30*b* of the locking member 30 is formed into a stepped shape, and the proximal end 30*a* and the distal end 30*c* thereof are bent downwardly.

In the illustrated embodiment the proximal portion 30*a* of the locking member 30 is provided on both opposite sides thereof with indentations 30*d* (see FIG. 2) for the engagement therein of the pair of projections 19 provided in the lower portion 17*b* of the well 17, as shown in FIG. 5. The locking member 30 and the slider body 10 are configured such that the locking member 30 is resiliently biased towards a locking position in which the distal end 30*c* and the stopper claw 30*e* of the locking member 30 protrude to a predetermined extent in the guide channel 14. In the locking position, the stopper claw 30*e* is sufficiently engaged with between coupling elements (not shown) of a slide fastener, so as to prevent the slider assembly 1 from being displaced.

As it can be seen in FIG. 5, the proximal end 20*b* of the pull-tab 20 has a cam member (cam means) 31 cooperating with the locking member 30, such that the locking member 30 takes the locking position when the pull-tab 20 is in the above-mentioned first angular end position, as shown in FIGS. 1 and 3-5, and the locking member 30 is moved towards an unlocking position when the pull-tab 20 is pivoted away from the first angular end position.

The sloping surfaces 15*c* of the recess 15 are provided on both sides of the longitudinal groove 16 with respect to the longitudinal direction of the slider body 10. The pull-tab 20 abuts against and is stopped at the sloping surfaces 15*c* of the recess 15 when the pull-tab 20 reaches a second angular end position, shown in dashed lines in the right-end portion of FIG. 6. In the second angular end position, the pull-tab 20 has an inclination of less than 180° with respect to the first angular end position, shown in dashed lines in the left-end portion of FIG. 6.

The cam member 31 can be shaped such that the locking member 30 takes the locking position also when the pull-tab 20 is in the second angular end position.

Advantageously, the transverse width of the intermediate portion 30*b* of the locking member 30 is essentially equal to the transverse width of the longitudinal groove 16, and the transverse width of the proximal portion 20*b* of the pull-tab 20 is essentially equal to the transverse width of the recess 15.

According to the slider assembly 1 configured as explained above, the risk that unwanted debris may be trapped between the locking member 30, the pull-tab 20 and the slider body 10 is dramatically reduced.

The relatively "high" lateral walls of the longitudinal groove 16 and the recess 15 offer a significant protection to the pull-tab 20 and the locking member 30.

The present invention is not limited to the above-described embodiment, which can be suitably changed without departing from the scope defined in the annexed claims.

The invention claimed is:

1. A slider assembly for a slide fastener, comprising: a slider body; a pull-tab; and a resilient locking member, wherein the slider body has upper and lower wings linked by a post and an essentially Y-shaped guide channel defined between the upper wing and the lower wing, wherein an upper surface of the upper wing has a recess extending in a longitudinal direction of the slider body, wherein the recess has two confronting side walls and a bottom wall disposed between the two confronting side walls, wherein the upper wing is provided with an aperture putting the recess in communication with the guide channel, wherein the pull-tab has a distal end adapted to be gripped and a proximal end pivotably mounted in the recess of the upper wing, between the two confronting side walls thereof, wherein the slider assembly is provided with a pivot pin which extends in a transverse direction of the slider body, through holes in the two confronting side walls and a hole in the proximal end of the pull-tab, wherein the pull-tab is provided with a window which is aligned with the aperture in the upper wing when the pull-tab is in a first angular end position relative to the slider body, wherein the locking member has a proximal end retained to the slider body, an intermediate portion extending in the recess around the proximal end of the pull-tab, and a distal end extending towards the guide channel through the window in the pull-tab and the aperture in the upper wing, wherein the locking member is configured such that the locking member is resiliently biased towards a locking position in which the distal end thereof protrudes to a predetermined extent in the guide channel, wherein the proximal end of the pull-tab has a cam cooperating with the locking member such that the locking member takes the locking position when the pull-tab is in the first angular end position, and the locking member is moved towards an unlocking position when the pull-tab is pivoted away from the first angular end position, wherein the bottom wall of the recess is provided with a longitudinal groove, wherein the intermediate portion of the locking member extends at least in part inside the longitudinal groove, wherein on at least one side of right and left sides of the longitudinal groove with respect to the longitudinal direction of the slider body the bottom wall of the recess forms a sloping surface slanting upwardly towards a front portion of the slider body, and wherein the pull-tab abuts against the sloping surface in a second angular end position, with an inclination of less than 180° with respect to the first angular end position.

2. The slider assembly according to claim 1, wherein the cam is configured such that the locking member takes the locking position also when the pull-tab is in the second angular end position.

3. The slider assembly according to claim 1, wherein in a front portion of the slider body a bottom wall of the longitudinal groove is provided with a well, and wherein the proximal end of the locking member is engaged with the well and retained to the slider body.

4. The slider assembly according to claim 3, wherein the longitudinal groove extends from a front of the aperture to a front wall of the well.

5. The slider assembly according to claim 1, wherein a transverse width of the intermediate portion of the locking member is essentially equal to a transverse width of the longitudinal groove, and wherein a transverse width of the proximal end of the pull-tab is essentially equal to a transverse width of the recess.

6. The slider assembly according to claim 1, wherein the upper surface of the upper wing is provided, in front of the sloping surface, with an inclined surface slanting downwardly towards the front portion of the slider body.

* * * * *